United States Patent [19]

Franklin

[11] Patent Number: 4,715,499

[45] Date of Patent: Dec. 29, 1987

[54] AUTOMOTIVE ROLL-UP TOOL KIT

[75] Inventor: Randall M. Franklin, Collinsville, Ill.

[73] Assignee: RVF Corporation, Collinsville, Ill.

[21] Appl. No.: 915,628

[22] Filed: Oct. 6, 1986

[51] Int. Cl.[4] ..... B65D 30/22

[52] U.S. Cl. ..... 206/373; 150/52 C; 206/459; 383/39

[58] Field of Search ..... 383/39; 206/372, 373, 206/459; 150/52 C

[56] References Cited

U.S. PATENT DOCUMENTS

| | | | |
|---|---|---|---|
| 1,094,009 | 4/1914 | Parkhurst . | |
| 1,434,350 | 10/1922 | Collins | 206/373 |
| 1,441,251 | 1/1923 | Steffens | 206/373 |
| 2,679,877 | 6/1954 | Leggett | 383/39 X |
| 3,749,233 | 7/1973 | McCormick, Jr. | 206/373 |
| 4,101,025 | 7/1978 | Jordan | 383/39 |
| 4,210,244 | 7/1980 | Westrick | 206/373 |

FOREIGN PATENT DOCUMENTS

| | | | |
|---|---|---|---|
| 2841558 | 3/1980 | Fed. Rep. of Germany | 206/373 |
| 345032 | 11/1904 | France | 150/52 C |
| 2035067 | 6/1980 | United Kingdom | 206/373 |

*Primary Examiner*—William Price
*Attorney, Agent, or Firm*—Glenn K. Robbins

[57] ABSTRACT

An automotive roll-up tool kit. The tool kit is of flexible plastic and has a plurality of compartments or open top pockets receiving the tools and increasing in size from one end of the kit to the other. The front of the compartment is constructed of transparent plastic for further identification of the tool with the top flap closed. A top turn over flap ensures that the tools do not fall out and is marked with registering names of the tools. A trouble-shooting instruction manual is inserted in one of the pockets. A tab at one end is provided with Velcro pads adapted to stick to mating Velcro pads on the back of the tool kit when the tool kit is rolled up.

8 Claims, 3 Drawing Figures

AUTOMOTIVE ROLL-UP TOOL KIT

BACKGROUND OF THE INVENTION

It has long been a problem for motorists to attend to emergency situations occasioned by malfunctioning of the engine, lights or other operating parts of the vehicle. Since the original equipment on the standard automobile includes only a jack and lug wrench repairs other than tire removal are substantially impossible without the proper tools which the average motorist does not have.

Further, the most commonly occuring malfunctions requiring trouble-shooting are not within the experience of the average motorist. Simple repairs which can easily be performed are beyond the realm of the driver and without proper instruction and tools there is necessitated upon breakdown an emergency long wait and considerable expense for a mechanic or tow truck.

SUMMARY OF THE INVENTION

By means of this invention there has been provided an automotive repair tool kit provided with the most commonly used tools enabling a motorist to handle simple emergency on the road repairs. The tool kit is further provided with a simply written instruction manual containing trouble-shooting directions for use in locating and repairing the malfunction.

The tool kit is of a roll-up construction flexible plastic construction having open top pockets receiving the tools. A top turn over flap is turned over the tools to retain them in the pockets when the spread out tool kit is rolled up. The top flap is provided with printed characters on the back of the flap in registry with the tools for ready tool identification and emplacement. A front pocket sheet is transparent for further see-through identification. By both of the afore-mentioned features, the tools can be identified before the top flap is opened which minimizes accidental removal of unwanted tools.

In order to secure the rolled up kit in the closed position, Velcro-like fastener pads are employed. A tab is provided at one end of the kit to which is secured a Velcro-like pad which is secured to a mating Velcro-like pad on the back of the kit in the rolled up position. Easy opening and closing of the kit is thereby obtained.

The pocket arrangement increases in height from one end of the tool kit to an opposite end. A hinge section connecting the top flap increases in like order such that the top flap which is of substantially uniform height may be simply opened and closed in an orderly fashion.

The tool kit is provided with the most commonly required simple tools for emergency road repairs. These range from a short fuse puller at one end to an elongated road flare and wrap-around distress flag at an opposite end which can be easily withdrawn for emergency use without opening the entire tool kit.

The emergency road repair kit is simply employed in the field and represents a low cost investment that is a significant aid for emergency repair situations. The flexible nature and durability of the roll-up construction provides further simplicity in opening and closing and access to the tools and compactness in storing the kit in the vehicle.

The above features are objects of this invention. Further objects will appear in the detailed description which follows and will be further apparent to those skilled in the art.

For the purpose of illustration of this invention a preferred embodiment thereof is shown in the accompanying drawing. It is to be understood that the drawing is for purpose of description only and that the invention is not limited thereto.

IN THE DRAWING

DESCRIPTION OF THE INVENTION

Figure 1:
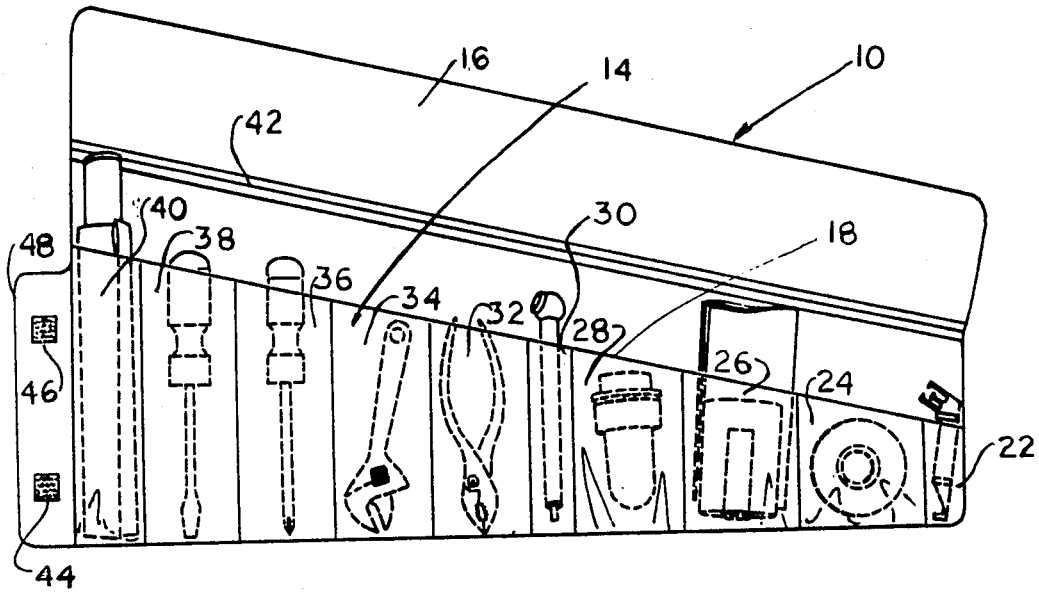
FIG. 1 is a top plan view of the unrolled automotive tool kit with the top protective flap opened.
Figure 2:
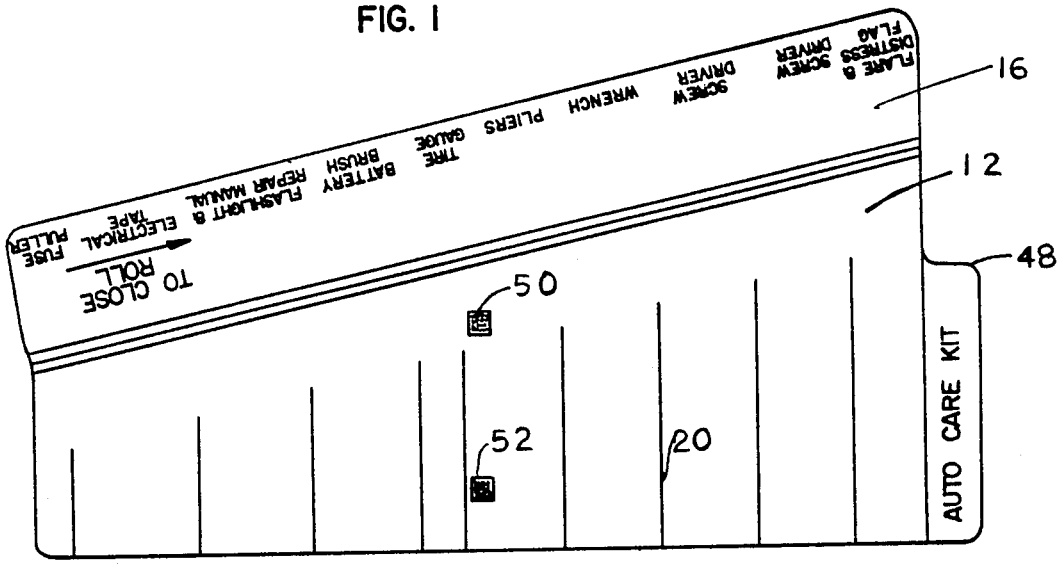
FIG. 2 is a bottom plan view of the unrolled automotive tool kit with the top flap opened and showing the tool markings.
Figure 3:
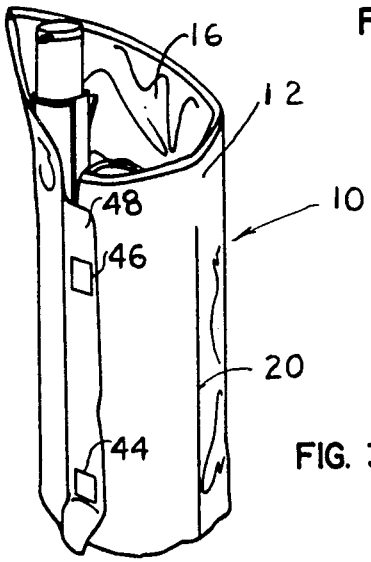
FIG. 3 is a pictorial view showing the rolled-up tool kit.

The roll-up automotive repair tool kit of this invention is generally identified by the reference numeral 10 in FIGS. 1, 2 and 3. It is comprised of a flexible plastic back sheet 12, a front flexible plastic pocket sheet 14 and a top turn over flap 16 which is formed as an extension of the back sheet 12.

The front pocket sheet is constructed of a transparent plastic for see-through identification of tools. It has a height at a top edge 18 increasing from the right end of the laid open kit shown in FIG. 1 to the left end to provide an orderly storage of tools of different lengths. The pocket sheet is secured by heat sealing to the back sheet at the bottom and at spaced vertical lines 20 to provide a plurality of open top pockets. These pockets starting at the right end are fuse puller pocket 22, friction tape pocket 24, flash light and instruction manual pocket 26, battery brush pocket 28, tire gauge pocket 30, pliers pocket 32, adjustable wrench pocket 34, phillips screw driver pocket 36, slot screw driver pocket 38, and emergency road flare and wrap around distress flag pocket 40.

The top turn over flap 16 is separated from the back sheet 12 by a creased hinge 42 formed in the plastic. The hinge 42 slants upwardly from the right end of the laid open tool kit to the left end of the kit as shown in FIG. 1 and is generally parallel to the top edge 18 of the pocket sheet. The top flap 16 is of substantially uniform height and is of sufficient height that when turned over from the position shown in FIG. 1 it extends over the open top of the tool pockets to prevent accidental dislodgement.

The top flap on the back as shown in FIG. 2 is further provided with characters such as the printed names of the tools. These characters are in registry with the pockets and the tool identification may be read with the flap closed to ensure proper tool removal when the flap is opened.

In order to secure the tool kit in the rolled-up position shown in FIG. 3, Velcro-like pads are employed. The Velcro-like pads provide sufficient holding power when engaged together to resist accidental separation but can be easily pulled apart when desired to be disengaged. The pads are used in mating relation with one pad comprising a large number of closely spaced hooking elements of flexible resilient plastic and the mating pad having a greater number of flexible loops of a resilient material. They are described in U.S. Pat. Nos. 2,717,437; 3,000,384 and 3,009,235 and form no part of this invention, per se.

Two Velcro-like pads 44 and 46 are secured to a tab 48 at the right end of the back sheet 12 of the tool kit as shown in FIG. 1. The tab is of substantially the same height as the right end of the back sheet 12 up to the hinge 42 such that as shown in FIG. 3 the opposite ends of the kit may be secured together. Mating Velcro-like pads 50 and 52 are secured at the rear surface of the back sheet 12 of the kit as shown in FIG. 2 at a location to provide registry with the tab pads 44 and 46 when the tool kit is rolled up.

USE

The automotive repair tool kit of this invention is very simply employed. Should the emergency flare or distress signal need to be employed, they may be removed without unrolling the kit. The flare through its positioning at the end pocket 40 is immediately accessible with the distress signal for use as required.

For emergency repairs of one type or another, the tool kit may be rapidly separated from the Velcro-like pads by grasping the tab 48 and pulling the pads apart. The kit may then be unrolled. Should the motorist not be familiar with the source of the trouble, he may refer to the instruction manual in pocket 26 which provides simple trouble-shooting instructions for the frequently encountered malfunctions that are within the capacity of repair for the motorist.

The top flap 16 indicates the location of the instruction manual pocket and the flap is turned over and opened for access to the pocket. Other tools may be withdrawn as required.

The hinging of the top flap generally parallel to the slanted top edge of the line of pockets from one end to the other ensures that the top openings of the pockets are covered by the flap 16 until the tools are desired to be withdrawn from the laid open tool kit. The top protective flap 16 further ensures that when the tool kit is rolled up with the flap turned down that the tools are tightly enclosed in the kit and can not fall out.

When the repair has been completed the tools are returned to their respective pockets and the top flap 16 is turned over the top of the pockets. The shorter right end shown in FIG. 3 is then rolled toward the left end of the tool kit when tightly rolled up the Velcro-like pads 46 and 48 on the tab 48 are in registry with the tabs 50 and 52 on the read surface of the tool kit. The pads are simply engaged by pressing them together to secure the kit in the rolled up position.

Various changes and modifications may be made within this invention as will be apparent to those skilled in the art. Such changes and modifications are within the scope and teaching of this invention as defined in the claims appended hereto.

What is claimed is:

1. A roll-up automotive repair tool kit comprising a back sheet of flexible plastic, a plurality of vertically extending open top tool pockets receiving commonly used automotive repair tools formed by a flexible plastic pocket sheet member attached to said back sheet and extending sequentially from one end of said cover sheet to an opposite end, a top roll over flap extending laterally from one end of said back sheet to an opposite end and forming a top extension of said back sheet and means for securing the tool kit in a rolled-up position comprising a Velcro-like pad means on the inside of said back sheet adjacent an end thereof and registering Velco-like pad means on a back surface of the back sheet adapted to mate with said first-mentioned Velcro-like pad means in the tool kit rolled-up position, said tool pockets increasing in height from one end of the kit to an opposite end and said flap being connected to said back sheet by a hinge means correspondingly increasing in height to said pockets to closely cover the open top of the tool pockets when closed and said flap being of substantially uniform height.

2. The automotive tool repair kit of claim 1 in which said top flap extends over an open top of said pocket when said flap is closed and is provided with registering tool characters for tool identification.

3. The automotive tool repair kit of claim 1 in which said pocket sheet member is constructed of transparent plastic for visual identification of the tools in said pockets.

4. The automotive tool repair kit of claim 1 in which said back sheet is provided with a vertically extending end tab and said first-mentioned Velcro-like pad means is secured thereto.

5. The automotive tool repair kit of claim 2 in which said pocket sheet member is constructed of transparent plastic for visual identification of the tools in said pockets and said back sheet is provided with a vertically extending end tab and said first-mentioned Velcro-like pad means is secured thereto.

6. The automotive tool repair kit of claim 1 in which said pockets contain in order from the shortest pocket at one end to the other end a fuse puller, electrical tape, a flash light and repair manual, a battery brush, a tire gauge, pliers, an adjustable wrench, a phillips screw driver, a slot screw driver and a flare and distress flag.

7. The automotive tool repair kit of claim 6 in which the flare and distress flag are accessible in the rolled-up tool kit without unrolling the kit.

8. The automotive tool repair kit of claim 1 in which the hinge means is formed by a crease separating the top roll over flap from the back sheet.

* * * * *